US006743119B2

(12) United States Patent
Lo

(10) Patent No.: US 6,743,119 B2
(45) Date of Patent: Jun. 1, 2004

(54) REINFORCED GOLF CLUB HEAD

(75) Inventor: Lai-Fa Lo, Taoyuan (TW)

(73) Assignee: Fu Sheng Industrial Co., Ltd (TW)

( * ) Notice: Subject to any disclaimer, the term of this patent is extended or adjusted under 35 U.S.C. 154(b) by 0 days.

(21) Appl. No.: 10/291,391

(22) Filed: Nov. 12, 2002

(65) Prior Publication Data

US 2004/0038750 A1 Feb. 26, 2004

(51) Int. Cl.[7] ..... A63B 53/04
(52) U.S. Cl. ..... 473/346
(58) Field of Search ..... 473/324, 345, 473/346, 328, 256, 290, 291, 292

(56) References Cited

U.S. PATENT DOCUMENTS 1,526,438 A * 2/1925 Scott ..... 473/305
1,582,836 A * 4/1926 Link ..... 473/346
4,438,931 A * 3/1984 Motomiya ..... 473/346
4,602,787 A * 7/1986 Sugioka et al. ..... 473/338
5,141,230 A * 8/1992 Antonious ..... 473/327
5,501,459 A * 3/1996 Endo ..... 473/346
5,908,356 A * 6/1999 Nagamoto ..... 473/224
5,961,394 A * 10/1999 Minabe ..... 473/305
6,572,491 B2 * 6/2003 Hasebe et al. ..... 473/349

* cited by examiner

*Primary Examiner*—Sebastiano Passaniti
(74) *Attorney, Agent, or Firm*—Bacon & Thomas, PLLC

(57) ABSTRACT

A reinforced golf club head includes a reinforcing plate, a curved sole plate, a striking plate and a crown plate. The reinforcing plate is welded to the sole plate in a lip area adjacent to the striking plate before the sole plate, striking plate and crown plate are joined together, so as to strengthen the sole plate and hence allow the lip area to withstand a relative large stress resulted from impact produced during striking a ball.

10 Claims, 4 Drawing Sheets

REINFORCED GOLF CLUB HEAD

BACKGROUND OF THE INVENTION

1. Field of the Invention

The present invention relates to a reinforced golf club head and, more particularly, to a reinforced golf club head in which a reinforcing plate is welded to a curved sole plate in a lip area adjacent to a striking plate before the sole plate, the striking plate and an crown plate are welded together, so as to strengthen the lip area of the sole plate.

2. Description of Related Art

A golf club head of prior art is shown in FIGS. 1 and 2. It includes a curved sole plate 91, a striking plate 92, a crown plate 93 and a sleeve 94. The sole plate 91 is made into a desired shaped and designs at its bottom. The striking plate 92 is grooved to improve the friction and accuracy for striking a ball, and the sleeve 94 is provided for receiving a shaft (not shown). These elements 91, 92, 93 and 94 are usually joined together by argon-arc welding, a means which is simple, inexpensive and suitable for mass production.

The argon-arc welded head generally comply with a standard strength and resistance against impact. However, impact stresses are repeatedly transmitted from the striking plate 92 to the sole plate 91, especially to its lip area 911 adjacent to the striking plate 92, during striking a ball. After the club head strikes a certain number of times, microcracks will appear in the lip area 911 of the sole plate 91.

Particularly, such a club head of a super-large size is usually much thinner in its thickness of the sole plate 91, striking plate 92 and crown plate 93 and so it is more possible to result in micro-crack in the lip area 911 of its sole plate. These microcracks degenerate the club head in its durability as well as its striking property.

Therefore, there is really a need to strengthen the lip area 911 of the sole plate 91.

SUMMARY OF THE INVENTION

The object of the present invention is to provide a reinforced golf club head in which at least one reinforcing plate is welded to a curved sole plate in a lip area adjacent to a striking plate, so as to strengthen the area and consequently improve durability of the club head.

Another object of the present invention is to provide a reinforced golf club head in which the reinforcing plate(s) may be provided with one or more holes of a geometrical or an irregular shape, so as to lighten the club head as well as to strength it.

To achieve the aforementioned objects, the present invention provides a reinforced golf club head comprising a reinforcing plate, a curved sole plate, a striking plate and a crown plate. The reinforcing plate is welded to the sole plate in a lip area adjacent to the striking plate before the sole plate, striking plate and crown plate are joined together, so as to strengthen the sole plate and hence allow the lip area to withstand a relative large stress resulted from impact produced during striking a ball.

Other objects, advantages and novel features of this invention will become more apparent from the following detailed description when taken in conjunction with the accompanying drawings.

DETAILED DESCRIPTION OF THE PREFERRED EMBODIMENT

The present invention is now to be described thereinafter by way of a preferred embodiment in reference with drawings.

Figure 3:
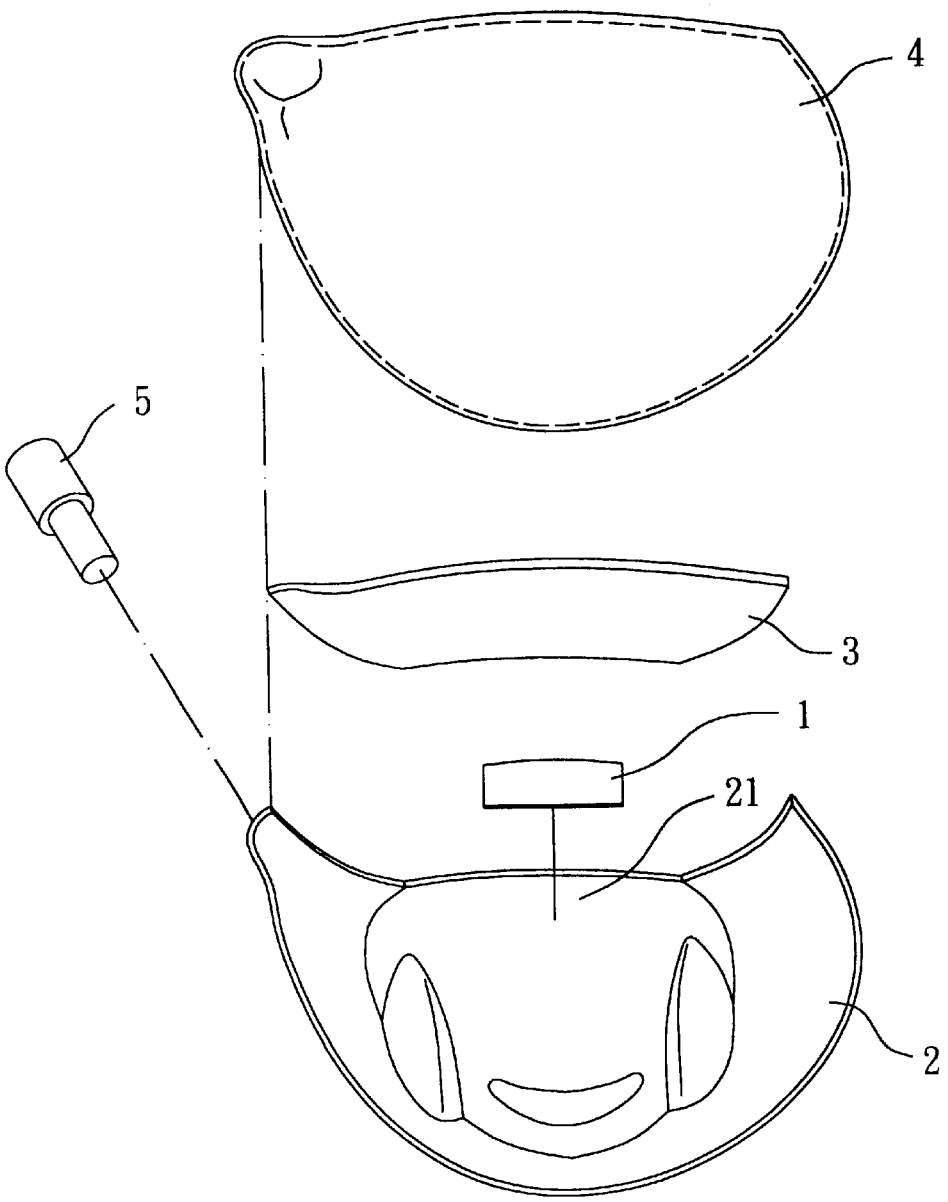
FIG. 3 is an exploded perspective view of a reinforced golf club head in accordance with the present invention.

FIG. 3 shows an exploded perspective view of a golf club head in accordance with the present invention. The club head includes at least one reinforcing plate 1, a curved sole plate 2, a striking plate 3, a crown plate 4 and a sleeve 5.

Figure 6:
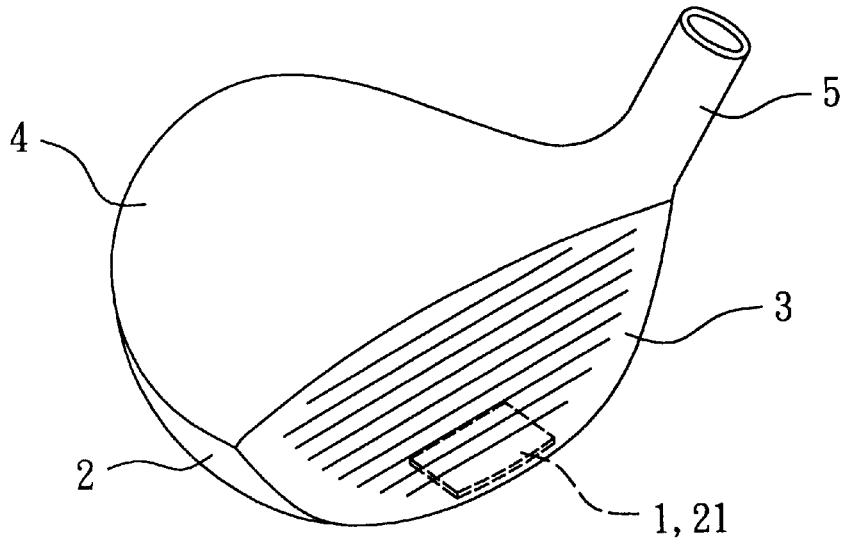
FIG. 6 is a perspective view of the club head of FIG. 3, showing the plates welded together.

The reinforcing plate 1 is a metal piece preferably made of the same material as the curved sole plate 2. The sole plate 2 can be made into a desired shape and design, such as by punching. The striking plate 3 may be grooved, as shown in FIG. 6, to improve the friction and accuracy striking a ball. The plates 1, 2, 3 and 4 are joined together to form a hollow body, i.e., a main body of the club head and the sleeve 5 is joined to the hollow body for receiving a shaft (not shown).

Figure 4:
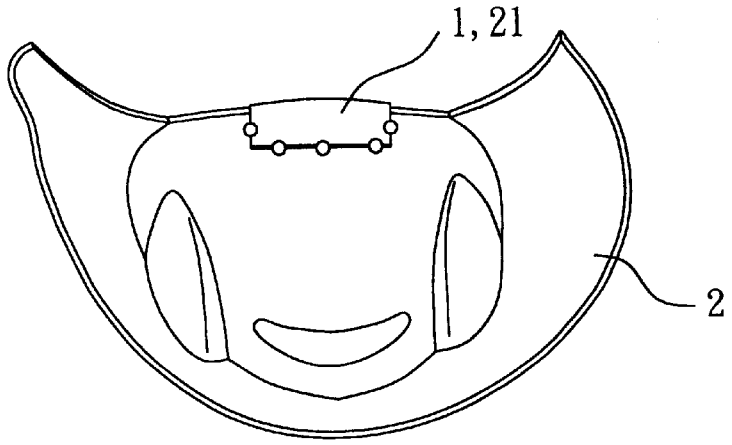
FIG. 4 is a top view showing a reinforcing plate of the club head of FIG. 3 welded to a curved sole plate.
Figure 5:
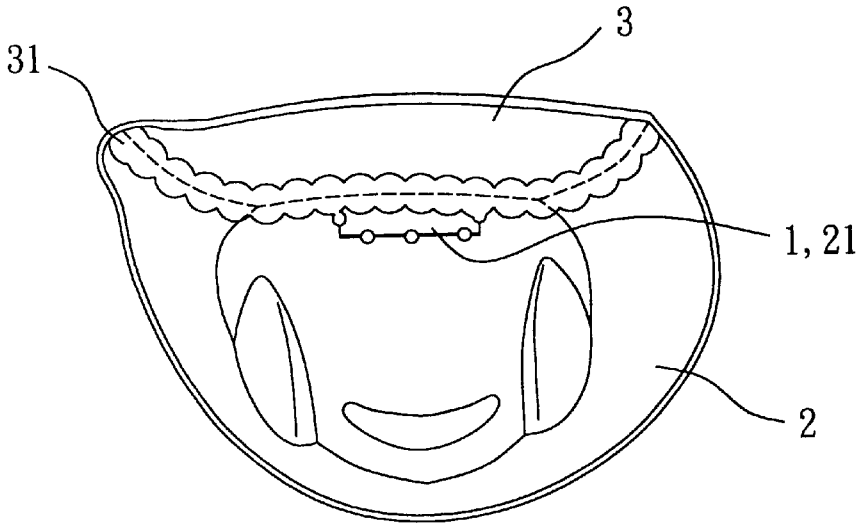
FIG. 5 is a top view showing a striking plate of the club head of FIG. 3 welded to the reinforcing plate and the curved sole plate.

FIGS. 4 to 6 show sequential procedures of the plates 1, 2, 3 and 4 to be joined together.

The reinforcing plate 1 is firstly joined by welding, preferably spot welding, to an inner face of the curved sole plate 2 in a lip area 21 adjacent to the striking plate 3, and so the reinforcing plate 1 can be placed flat on and joined to the sole plate 2 without being added by a raised welded seam 31 appearing on the boundary between the sole and striking plates 2 and 3. To be short, the reinforcing plate 1 is welted to the inner face of the sole plate 2 in the lip area 21 before the other plates 2, 3 and 4 are welded together to form the club head.

The resulting club head is strengthened in the lip area 21, which now may withstand a relative large stress resulted from the impact produced during striking a ball. Preferably, the reinforcing plate 1 is arranged and welded so that a side edge thereof extends along or slightly projects from an outside edge of the curved sole plate 2 confronting with the striking plate 3. This arrangement makes the reinforcing plate 1, sole plate 2 and striking plate 3 easier to be welded closely together by a same welded seam 31.

In a club head of a super-large size, the sole plate 2, striking plate 3 and crown plate 4 are often required to be made as thin as possible, on the condition of no reduction of the total weight of the whole head, in order to enable a striking ball to travel as far as possibly. In addition to any club head of normal size, the reinforcing plate 1 is more preferably provided in such a super-large head to strengthen the thinner sole plate 2 and to compensate for the amount of reduced weight caused by the thinner plates 2, 3 and 4.

A durability test has been made for super-large heads (184 grams in total weight and 1 mm thick in their sole plates) with and without such a reinforcing plate 1. Micro-cracks are appeared in the lip area of the sole plate without such a reinforcing plate approximately after struck 1500 times, but struck 2600 times for a lip area with such a reinforcing plate. The test shows that the reinforcing plate 1 can significantly strengthen the sole plate 2 of a club head, especially one of a super-large size, and protect its lip area from micorcracking. In other words, the reinforcing plate 1 provides an improved durability for the inventive club head.

Figure 7:
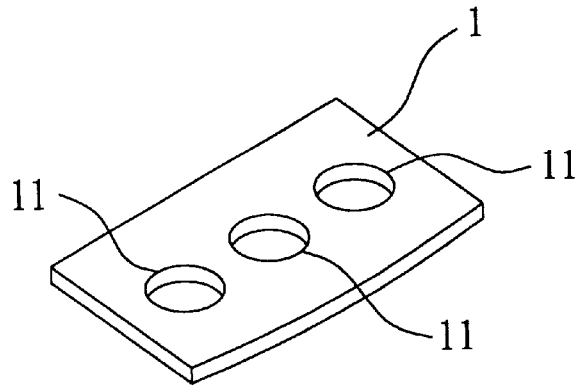
FIG. 7 is an enlarged perspective view of the reinforcing plate of the club head of FIG. 3.

Referring to FIG. 7, the reinforcing plate 1 can be provided with one or more holes 11 if necessary, in order to avoid an excessive total weight of the club head. The hole(s) 11 may have either a geometrical or an irregular shape.

Figure 1:
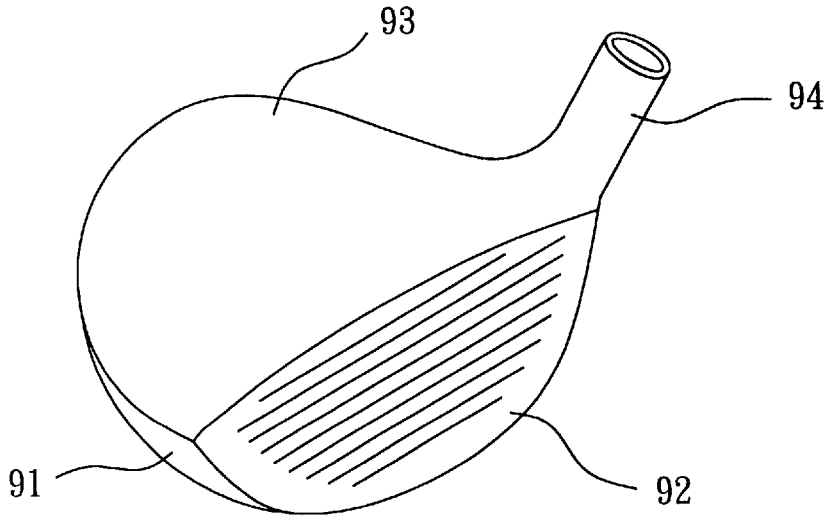
FIG. 1 PRIOR ART
FIG. 1 is a perspective view of a golf club head in prior art.
Figure 2:
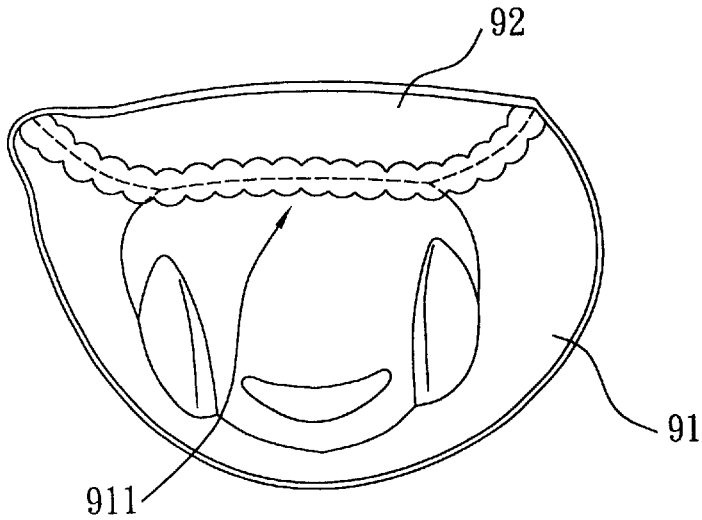
FIG. 2 PRIOR ART
FIG. 2 is a perspective view showing a curved sole plate and a striking plate of the club head of FIG. 1 welded together.

Referring again to FIGS. 2 and 5, the inventive club head includes a reinforcing plate 1 which is welded to the curved sole plate 2 in the lip area 21 before the other plates 2, 3 and 4 are welded together. In contrast to the weakness of the sole plate 91 of the prior art club head shown in FIG. 2, the inventive club head illustrated in FIG. 5 not only has an improved strength and durability in its sole plate 2 but also is simple enough to be manufacture.

While the principles of this invention have been disclosed in connection with a specific embodiment, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A reinforced golf club head, comprising:

a sole plate;

a striking plate joined to said sole plate;

a crown plate joined to said sole plate and said striking plate;

said sole plate having a lip area adjacent to said striking plate;

at least one reinforcing plate joined to an inner surface of said sole plate in said lip area to strengthen said sole plate; and said reinforcing plate has at least one side edge engaged with a rear surface of a bottom edge of the striking plate so that the striking plate proximate its bottom is reinforced.

2. The reinforced golf club head as claimed in claim 1, wherein said reinforcing plate is joined to said sole plate in said lip area before said sole plate, said striking plate and said crown plate are joined together.

3. The reinforced golf club head as claimed in claim 1, wherein said reinforcing plate has at least one hole defined therein.

4. The reinforced golf club head as claimed in claim 3, wherein said hole has a geometrical shape.

5. The reinforced golf club head as claimed in claim 3, wherein said hole has an irregular shape.

6. The reinforced golf club head as claimed in claim 1, wherein said golf club head has a super-large size.

7. The reinforced golf club head as claimed in claim 1, wherein said side edge extends along a front edge of said sole plate confronting with said striking plate.

8. The reinforced golf club head as claimed in claim 1, wherein said reinforcing plate has a side edge slightly projecting from a front edge of said sole plate confronting with said striking plate.

9. The reinforcing golf club head as claimed in claim 1, further comprising a sleeve for receiving a shaft.

10. The reinforced golf club head as claimed in claim 1, wherein the reinforcing plate is welded to the sole plate.

* * * * *